US005250383A

United States Patent [19]

Naruse

[11] Patent Number: 5,250,383

[45] Date of Patent: Oct. 5, 1993

[54] PROCESS FOR FORMING MULTILAYER COATING

[75] Inventor: Yasuhito Naruse, Shizuoka, Japan

[73] Assignee: Fuji Photo Film Co., Ltd., Kanagawa, Japan

[21] Appl. No.: 658,891

[22] Filed: Feb. 22, 1991

[30] Foreign Application Priority Data

Feb. 23, 1990 [JP] Japan ..... 2-41135
Jun. 14, 1990 [JP] Japan ..... 2-153861

[51] Int. Cl.[5] ..... G03G 5/04; B05D 1/36

[52] U.S. Cl. ..... 430/131; 430/133; 427/477; 427/483

[58] Field of Search ..... 430/131, 127, 133; 427/477, 483

[56] References Cited

U.S. PATENT DOCUMENTS 4,268,542 5/1981 Sakakibara et al. ..... 427/195
4,711,833 12/1987 McAneney ..... 430/131

FOREIGN PATENT DOCUMENTS 971564 2/1959 Fed. Rep. of Germany .
1671626 9/1971 Fed. Rep. of Germany .
2658839 12/1976 Fed. Rep. of Germany .
50-7481 3/1975 Japan .
50-133008 10/1975 Japan .
53-36364 10/1978 Japan .
62-51670 10/1987 Japan .
63-249148 10/1988 Japan .
8501678 4/1985 PCT Int'l Appl. .
2054885 7/1980 United Kingdom .

*Primary Examiner*—John Goodrow
*Attorney, Agent, or Firm*—Sughrue, Mion, Zinn, Macpeak & Seas

[57] ABSTRACT

A process for forming a multilayer coating. The process enables coating of multiple layers by a continuous process in which mixing and diffusion between the layers is prevented. The process is particularly useful for producing, e.g., electrophotographic photoreceptors or photosensitive printing plate precursors comprising two or more coating layers.

9 Claims, 5 Drawing Sheets

PROCESS FOR FORMING MULTILAYER COATING

FIELD OF THE INVENTION

The present invention relates to a process for forming a multilayer coating. The process enables coating of multiple layers by a continuous process in which mixing and diffusion between the layers is prevented. The process is particularly useful for producing, e.g., electrophotographic photoreceptors or photosensitive printing plate precursors comprising two or more coating layers.

BACKGROUND OF THE INVENTION

It is known to provide a multilayer coating film comprised of an aqueous coating composition by a method in which, e.g., multiple layers of a silver halide emulsion having gelatin as a binder are simultaneously applied on a continuously moving support by means of a slide hopper type coater or an extrusion hopper type coater. Immediately after coating, the multilayers are coagulated in a cooling zone utilizing the sol to gel change phenomenon of a hydrophilic colloid such as gelatin so that the viscosity of the multilayers becomes extremely high, e.g., in the range of from $1\times10^4$ to $1\times10^5$ centipoise (cP). In this state, the layers hardly mix with each other. Thereafter, the temperature of the system is gradually raised to bring about drying of the multilayers, usually with hot air to facilitate evaporation of the solvent or the like. The result is a coating film comprised of multiple layers.

On the other hand, in the case where an organic type coating composition (a composition containing an organic solvent) is merely applied in multilayers and then dried, diffusion and/or mixing is apt to occur in the bead portion being coated and in the freshly coated multilayers between the time of application and the time of drying. Diffusion and/or mixing also is apt to occur in between the coated layers and the underlayers since the surface tension of organic coating compositions is low compared to the surface tension of an aqueous type coating composition, and further, since there is no sol to gel conversion step, diffusion/mixing is liable to occur during the step of drying. That is, in a coating composition comprising an organic solvent, there are no sol to gel type conversion materials having compatibility with a broad range of ingredients which can be used in the organic solvent the way in which gelatin can be used in an aqueous solvent.

Accordingly, it is very difficult to obtain a coating film in a state in which layers thereof remain fully discriminated from each other, particularly in the case of using an organic type coating composition.

For the foregoing reasons, in the case of forming a multilayer coating film comprising an organic solvent, a method in which layers are successively applied and dried one after another has been generally used. As such a successive application and drying system, there are known methods in which layers are sequentially applied and dried, methods in which a plurality of application and drying portions are provided so that application and drying are continuously performed, and so on. In the former method, however, an extremely long manufacturing time is involved so that the manufacturing cost becomes extremely large. In the latter method, on the other hand, the number of application and drying stages corresponds to the number of layers, so that the provision of extremely expensive manufacturing equipment is required and the manufacturing cost becomes extremely large.

As described above, various methods for obtaining a multilayer coating film have been proposed until now. Of those methods, the method in which a coating film is applied and dried layer by layer requires extremely large-scale equipment. The methods in which a bead is formed by a multilayer slide die or in which a curtain film is formed by a multilayer die so as to form a simultaneously multilayer coated film are not effectively used for the coating of a composition comprising an organic solvent, although the method can be effectively used for coating a composition such as a photosensitive material or the like by taking advantage of the sol to gel conversion.

The present inventors have made investigations in order to solve problems as described above, and have discovered a process for forming a multilayer coating film which is disclosed in Japanese Patent Publication No. Sho-62-51670. In this method, an electron-beam hardenable resin is added to a non-aqueous coating composition (a coating composition comprising an organic solvent). Thereby, it becomes possible to realize formation of a multilayer film continuously by multilayer application of a coating composition comprising a non-aqueous solution, a result which has been very difficult to obtain by the conventional methods. The method, however, has the technical limitation that resin to be hardened by electron beams must be contained in the coating composition, thus the coating composition is increased in viscosity, and so on.

In the art of making photosensitive printing plate precursors, most photosensitive printing plate precursors have been of the single layer type and have been produced by a method such as wheeler coating, roll coating, bar coating, bead coating, or the like.

On the other hand, various photosensitive printing plate precursors having a multilayer configuration have been disclosed, for example, in JP-B-53-36364, JP-B-50-7481, (the term "JP-B" as used herein means an "examined Japanese patent publication") JP-A-50-133008 (the term "JP-A" as used herein means an "unexamined Japanese patent publication"), DAS 1,671,626, and the like. In producing such printing plate precursors, methods such as wheeler coating, roll coating, gravure bar coating, bead coating, or the like have been used so that a lower layer is first applied and dried, and then an upper layer is applied and dried to thereby produce a photosensitive printing plate precursor having multilayers.

However, these methods of making a multilayer photosensitive printing plate precursor are deficient with respect to the following points. That is, in the process for wheeler coating, there was a problem in that since a thick film is spread by a centrifugal force, a lower layer is apt to be dissolved in the upper layer liquid in the spreading step particularly in the case where the kind of solvent in the upper layer is the same as that in the lower layer, and therefore it is difficult to obtain a film having a configuration in which upper and lower layers remain fully separated from each other.

On the other hand, in the process for roll coating, gravure coating, bar coating, or the like, there is a problem in that since coating is performed by bringing a coating roll, a gravure roll, a bar, or the like, into contact with an already-coated film surface, there is a possibility that when coating of the upper and lower layers is performed with the same group solvent, a lower layer surface is dissolved by the solvent in the upper coating layer. In an extreme case, the underlayer may even be physically damaged. The range of suitability of this type of coating is therefore extremely limited. Further, in the process for bead coating an upper layer onto an underlayer, when the same type of solvent is used for the upper and lower layers (i.e., hydrophobic or hydrophilic), the lower layer is inevitably swelled or dissolved in between coating and drying. Therefore, even this method was not always satisfactory.

Conventionally, attempts to form a coating film with maintenance of separation between multilayers have involved using solvents for the respective layers which are hardly mutually dissolved, and it has been difficult to form a multilayer film using solvents capable of being mutually dissolved and by means of roll coating, gravure coating, bar coating, bead coating, or the like.

SUMMARY OF THE INVENTION

An object of the present invention is to solve the foregoing problems in the prior art and to provide a process for forming a multilayer coating film at a low cost without having any significant limitations with respect to the materials to be coated and in which coating compositions of both the aqueous solution type and the organic solvent type can be used.

A further object of the present invention is to provide a coating process by which high-quality multilayer photosensitive printing plate precursors or electrostatic photoreceptors can be simply and economically produced, and in which the foregoing problems in the prior art, that is, interlayer mixing generated in production of photosensitive multilayer printing plate precursors, can be extremely reduced.

The foregoing objects of the present invention can be attained by a process for forming a multilayer coating film, and by a process for producing photosensitive printing plate precursors, wherein a first coating film layer is coated or charged particles of a first atomized coating composition are made to electrostatically adhere onto a body to be coated so as to form a first coating film layer, and charged particles of a second atomized coating composition are made to electrostatically adhere onto the surface of the first coating film layer before the first coating film layer becomes fully dried so as to form a second coating film layer, whereby at least two coating film layers are formed on the body to be coated.

According to the present invention, a lower coating layer can be applied by using a conventionally known means such as roll coating, gravure coating, bar coating, bead coating, or the like, or by using an electrostatic coating method for the use of forming an upper layer. Preferably, the first film layer is formed with charged particles of an atomized coating composition which is obtained by charging a coating composition after it is atomized in advance.

In the multilayer coating film formed by the foregoing method, no diffusion or mixing is caused between the first and second coating film layers even in the state where the layers are not yet perfectly dried. That is, according to the present invention, the process for producing a photosensitive printing plate precursor by applying a plurality of layers of a photosensitive coating component on a support is characterized in that after the formation of a prescribed layer, particles of a photosensitive coating component are made to successively electrostatically adhere on the prescribed layer to thereby form the next photosensitive coating film layer.

DETAILED DESCRIPTION OF THE INVENTION

Atomized particles of a coating composition can be obtained by various atomizing apparatus such as a rotary bell, a spray nozzle, an ultrasonic atomizing apparatus, or the like. Charged particles of an atomized coating composition may be obtained in such a manner that a coating composition is atomized and charged at the same time or that a coating composition is atomized in advance and then charged. Such apparatuses are well-known and reference can be made to, e.g., Kirk-Othmer, *Encyclopedia of Science and Technology,* Volume 6, pages 417–419, the disclosure of which is incorporated herein by reference.

The present invention concerns the provision of a second or subsequent coating layer onto a first or immediately underlying coating layer. Any number of layers can be formed by the process of the present invention. For purposes of brevity, the first or immediately underlying coating layer will hereafter be referred to as the "first" coating layer, and the second or subsequent coating layer coated on the immediately underlying coated layer will be referred to as the "second" coating layer. Preferably, but not necessarily, the first coating film layer is formed through a process in which a coating composition is atomized in advance and then charged to thereby obtain charged particles of an atomized coating composition, and the particles of the coating composition are made to electrostatically adhere onto a body to be coated. The first coating layer may, however, be formed by any conventional process. The second coating layer is formed on the first coating layer.

An important feature of the present invention is that at least the second coating layer is formed by electrostatically adhering charged particles of an atomized coating composition onto the first coating film layer, and that the first layer onto which charged particles of an atomized coating composition are to be adhered has not yet dried before coating of the second layer. Preferably the viscosity of the first layer, at the time of coating the second layer, is about 100 cP or more, and more preferably several hundred cP or more.

Preferably, the second coating film layer et seg are formed through a process in which the coating composition is atomized in advance and then charged to thereby obtain charged particles of an atomized coating composition, and the particles of the coating composition are then made to adhere electrostatically onto the surface of the first coating film layer or a subsequently coated one.

A preferred embodiment of the present invention will be described with reference to the accompanying drawings.

Figure 1:
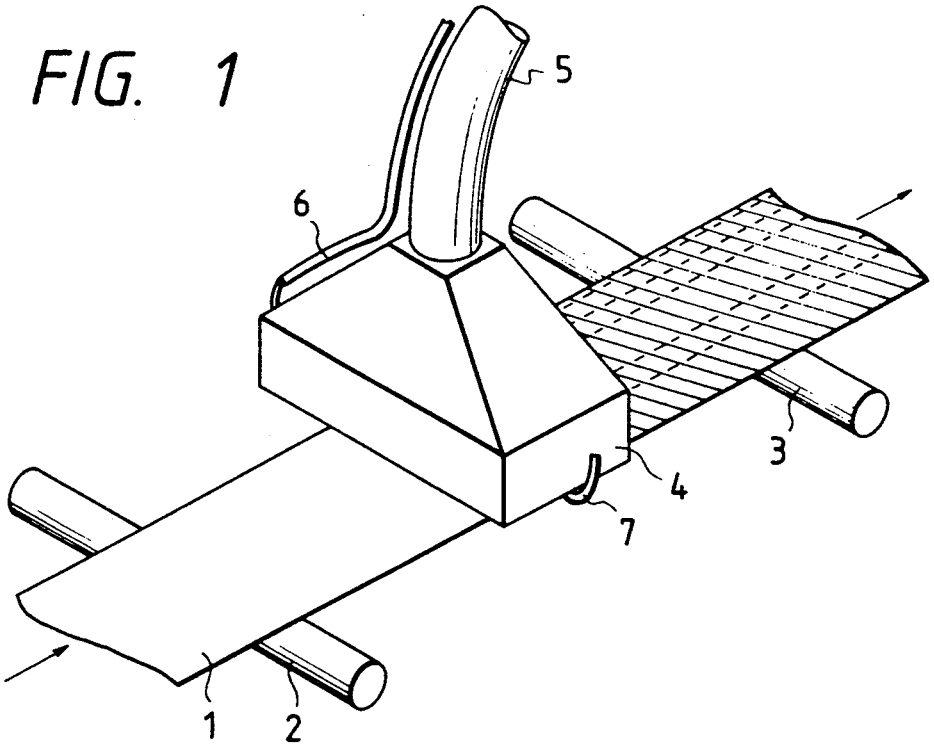
FIG. 1 is a perspective view showing the vicinity of the supply opening.

The positioning of the supply opening with respect to the body to be coated can be seen in FIG. 1.

Figure 4:
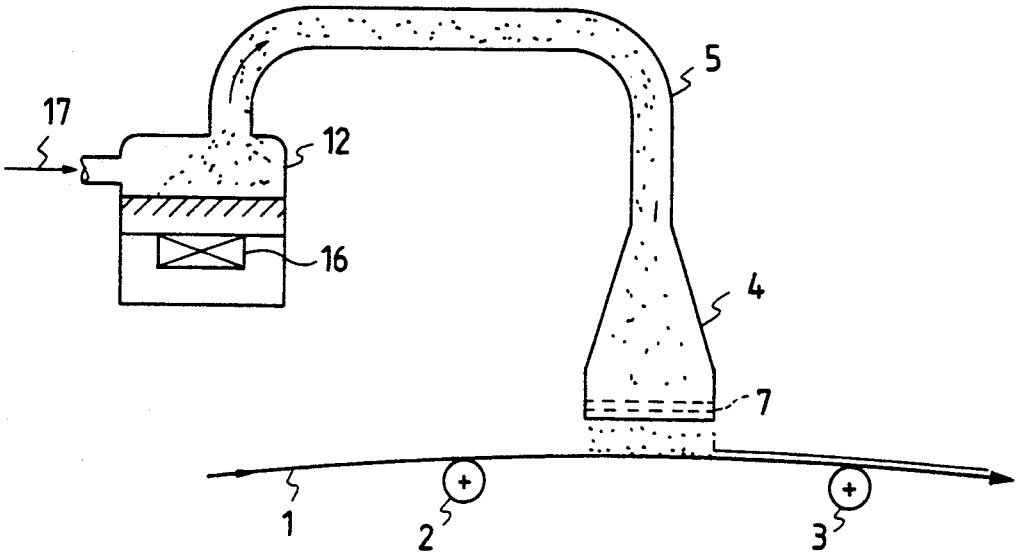
FIGS. 4 and 5 are schematic sectional views showing the steps of forming a coating layer.
Figure 5:
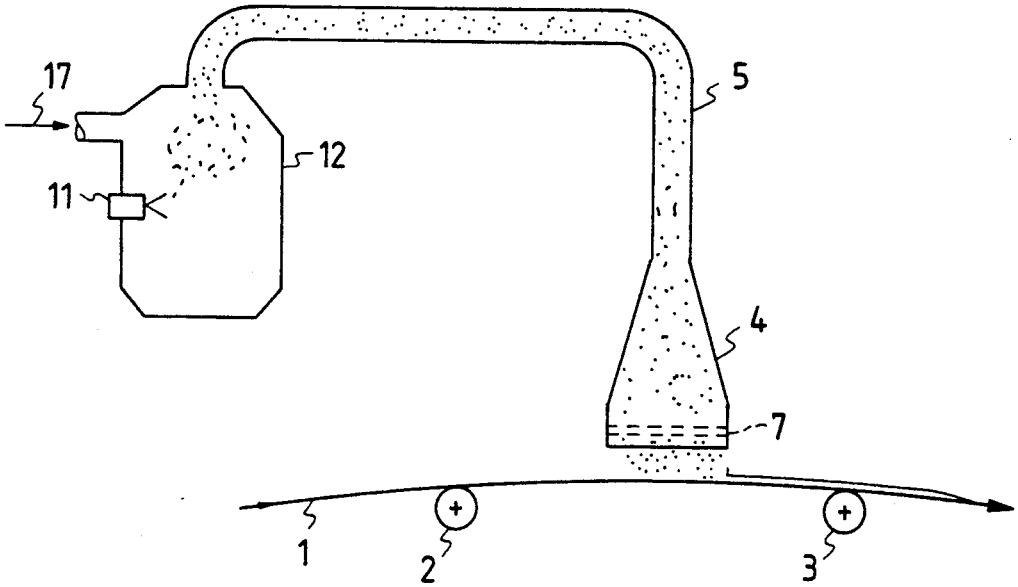

The steps in which a coating composition is atomized in advance and then charged so as to obtain charged particles of an atomized coating composition, and the charged particles of the atomized coating composition are then made to adhere electrostatically to a surface to be coated thereby forming a coating film layer, can be seen in FIGS. 4 and 5. That is, a coating composition is atomized in an atomizing room 12 by an ultrasonic atomizing machine 16 or an atomizing apparatus 11 such as a rotary bell, a spray nozzle, or the like, to thereby obtain particles of an atomized coating composition. The particles of the coating composition are carried by a carrier gas 17 from the atomizing room through a transport tube 5 to a nozzle or supply opening 4. Of the particles of the coating component, those having a large diameter collide against the respective wall surfaces of the atomizing room 12 and the transport tube 5 so as to be eliminated before the particles reach the supply opening 4. The viscosity of the particles is increased during travel because of evaporation of a solvent in the particles on the way to the supply opening 4.

Figure 3A:
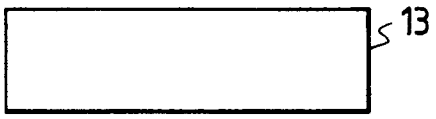
FIG. 3, diagrams (a), (b), and (c) are plans showing examples of the supply opening discharge outlet section.
Figure 3B:
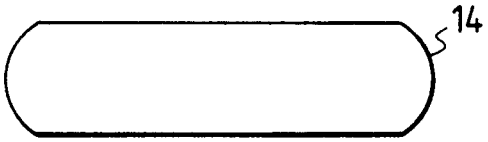
Figure 3C:
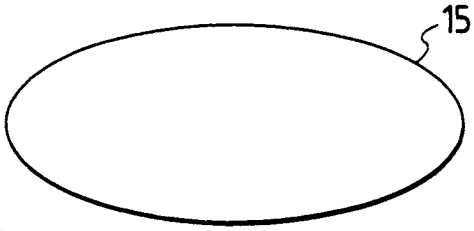
Figure 2A:
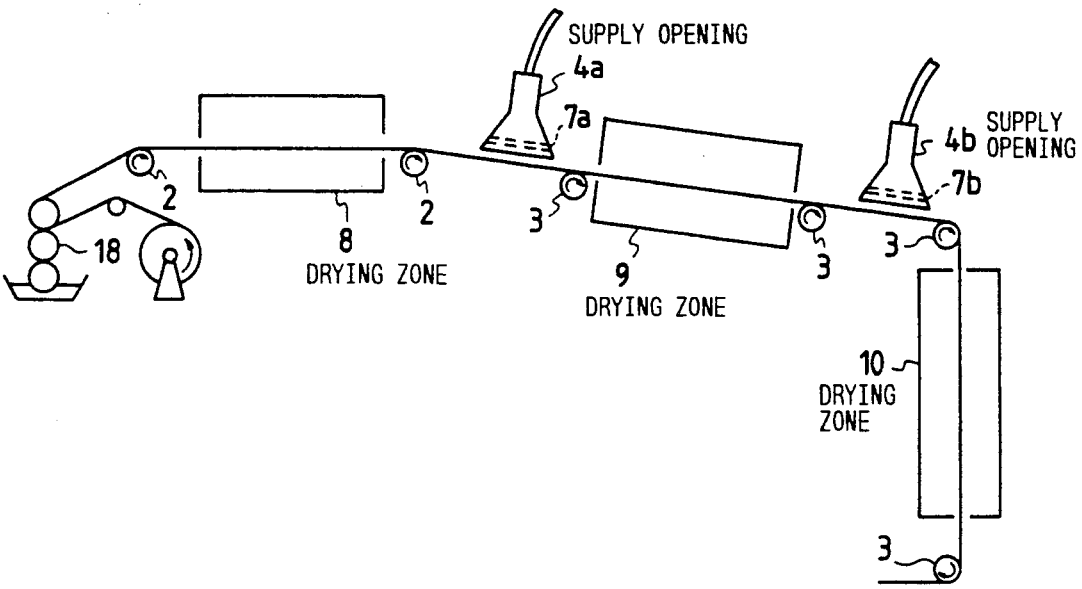
FIG. 2, diagrams (a), (b), (c) and (d) are schematic sectional views showing the steps of forming a paint film of two layers or more.
Figure 2B:
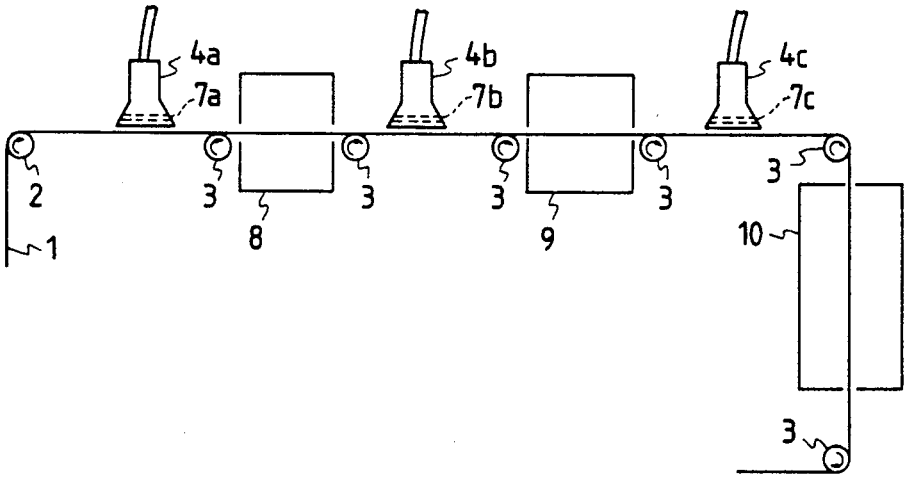
Figure 2C:
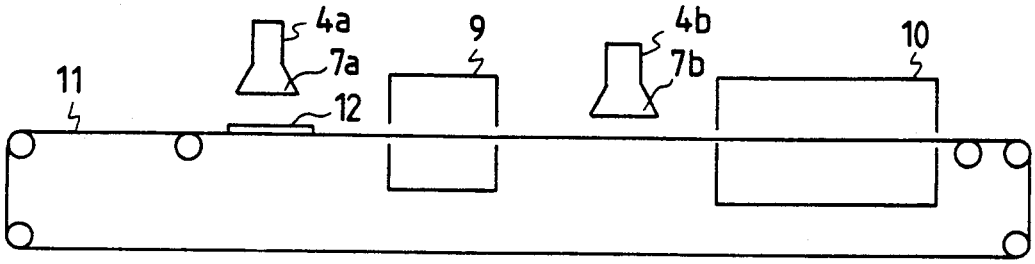
Figure 2D:
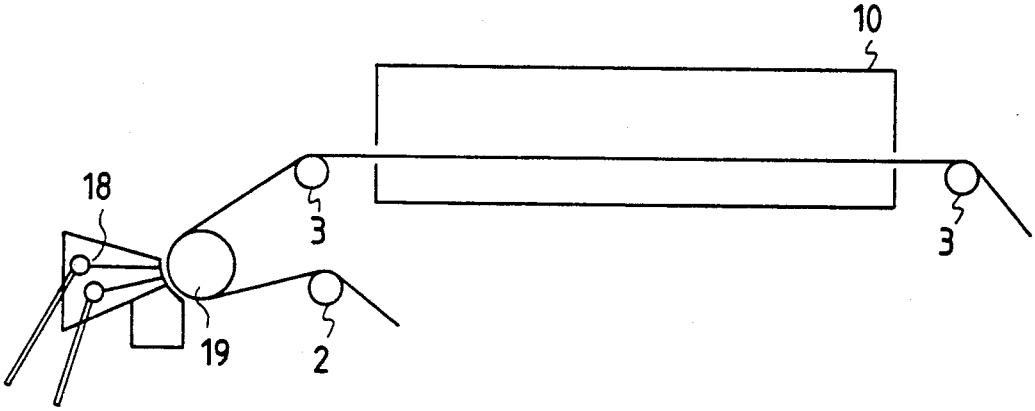

The discharge outlet of the nozzle has an electrode 7, by which the particles of atomized coating composition are charged so as to be electrified and the charged particles, in laminar state, are made to electrostatically adhere onto the body to be coated so as to form a coating film layer. The sectional shape of the discharge outlet of the nozzle is not strictly limited, so that it may be a rectangle as shown in diagram (a) of FIG. 3, or may be a rectangle with its short sides rounded as shown in the diagram (b) of FIG. 3, or further may be an elongated ellipsoid as shown in diagram (c), of FIG. 3.

The electrode 7 is preferably the type which extends linearly along the long side of the rectangle and slightly enters the inside of the rectangle section and which has one terminal outside the rectangle is preferably used. However, the shape of the electrode is not limited to this. The other terminal of the electrode is connected to a high-voltage generator through an electrode cable 6 so that a voltage from several kilovolts tens of kilovolts is applied to the terminal.

Support 1 is running while being guided by path rollers 2 and 3. The particles of the coating composition which have reached the nozzle discharge outlet are made to adhere electrostatically onto a body to be coated 1 so that a coating film layer uniform in thickness can be formed on the body to be coated.

The desired condition of the coating immediately after spraying is a smooth wet film with some leveling characteristics. The coating composition is actually applied as tiny droplets which flow upon impact with the surface. If the droplets do not contain enough solvent, they cannot flow and level properly, and uneven films may result. When too much solvent is used, a thin coating, which has a high incidence of defects, may be obtained. The amount of solvent to be used may vary widely and is easily adjusted depending on the material to be coated, the characteristics of the solvent selected, the coating conditions, the substrate, etc.

Diagrams (a), (b) and (c) of FIG. 2 are schematic sectional views wherein the above steps of forming a paint film are adapted to forming two layers or more. In FIG. 2, each of supply openings 4*a*, 4*b*, and 4*c* is the same as the supply opening 4 shown in FIG. 4., 6 represents an electrode cable, 7*a*, 7*b* and 7*c* represent electrodes, 8, 9 and 10 represent drying zones, 11 represents a belt, and 12 represents a sheet-like body to be coated. And diagram (d) of FIG. 2 is a schematic sectional view of an extrusion coater 18 and a drying zone 10. In this diagram, 19 represents a back-up roller.

First, the process illustrated in diagram (a) of FIG. 2 will be described.

Support 1 is running while being guided by path rollers 2 and 3. A first layer is formed on the surface of the support by a roll coater 18, and slightly dried in a drying zone 8. Next, a second coating film layer is formed on the surface of the first layer by means of the supply opening 4*a*, and slightly dried in a drying zone 9. Then, a third coating film layer is formed on the surface of the second layer by means of the supply opening 4*b*, and finally dried in a drying zone 10.

Slight drying means only that the film surface is brought into a sufficiently dried state as necessary for the prevention of layer mixing in the drying zones 8 and 9 prior to the subsequent coating steps. For the prevention of mixing, it is usually sufficient if the first and second layers are not fully dried, but the film surface viscosity is increased to at least about at least 100 cP or preferably several hundred cP. The residual solvent can be removed as necessary in drying zone 10. Therefore, assuming that the same quantity of coating is applied by the respective coating steps, the length of residency in each of drying zones 8 and 9 can be considerably reduced in comparison with drying zone 10.

It is possible to suitably select the degree of drying of each of the layers in accordance with the desired degree of layer separation. In order to improve the degree of layer separation, it is also desirable to control the diameter and viscosity of liquid drops blown out of supply openings 4*a*, 4*b*, 4*c*, or the like, so as to adhere on the film surface. That is, if the diameter of the liquid drops is too large, the film surface of a lower layer is apt to be dissolved, and therefore it is necessary to select the maximum value of the liquid drop diameter so as to be about 50 $\mu$m.

Similar to this, if the viscosity of the liquid drops is too low, an increase in mixing with a lower layer is apt to be caused, and therefore it is desirable to select a viscosity so as not to be lower than 5 cP. If the viscosity is too high, that is, not lower than 100 cP, on the contrary, it is difficult to form a multilayer film because a film is hardly made smooth. When a lower layer or layers are not perfectly dried in the case of the application of two or more layers, however, there is sometimes a case where a film is smoothly spread even if the viscosity is not lower than 100 cP.

Next, the process shown in diagram (b) of FIG. 2 will be explained.

Support 1 is running while being guided by a path roller 2. A first coating film layer is formed on the surface of the support by supply opening 4*a*, and slightly dried in drying zone 8. A second coating film layer is formed on the surface of the first layer by supply opening 4*b*, and slightly dried in drying zone 9. Further, a third coating film layer is formed on the surface of the second layer, and finally dried in drying zone 10.

In diagram (c) of FIG. 2, a sheet-like body 12 to be coated is conveyed by a belt 11. A first coating film layer is formed on the surface of the body to be coated by a supply opening 4, and partially dried as necessary in drying zone 9. A second coating film layer is formed on the surface of the first layer, and finally dried in drying zone 10.

According to the present invention, it is sufficient that all the coating film layers are finally fully dried after the last coating film layer has been formed, and therefore a multilayer coating film can be formed by extremely compact equipment.

As for the coating compositions which may be used according to the present invention, selection can be made from a large variety of coating compositions without regard to whether the composition is of the aqueous solution type or the non-aqueous solution type, so long as it can be atomized.

As examples of aqueous coating compositions (compositions comprising an aqueous carrier), there may be mentioned a coating composition prepared in such a manner that a resin such as a copolymer of acrylic ester and an acrylic acid or a methacrylic acid as described in JP-B-61-28986; a copolymer of styrene, acrylic ester, an acrylic acid or a methacrylic acid; a copolymer of acrylic ester, styrene, acrylonitrile or the like and an acrylic acid, a methacrylic acid, a maleic acid, an itaconic acid, or the like; a vinyl group polymer such as polyvinyl alcohol, polyvinyl acetate, polyvinyl pyrrolidone, or the like; etc., and the selected resin is dissolved or dispersed in water by any conventional well-known method.

As examples of the coating composition of the non-aqueous solution type (i.e., comprising an organic solvent), there may be mentioned a coating composition in which various kinds of resin is dissolved or dispersed in an organic solvent in the same manner as in the above case. For example, there is a solution in which resin such as a vinyl-chloride/vinyl-acetate group copolymer, acetal group resin, vinyl chloride/acetate group resin, urethane resin, acrylonitrile butadiene resin, or the like is dissolved in an ester group containing a solvent such as methyl acetate, ethyl acetate, butyl acetate, ethyl lactate, or the like; a ketone group containing a solvent such as acetone, methyl ethyl ketone, methyl isobutyl ketone, cyclohexanone, or the like; n- or isobutanol; xylol; or the like.

As for other resins, there may be mentioned natural resins such as shellac, rosin, or the like; novolac phenol resins such as phenol formaldehyde resin, m-cresol formaldehyde resin or the like; a single polymer of an unsaturated carboxylic acid such as a poly acrylic acid, poly methacrylic acid, methacrylic acid-styrene copolymer, a methacrylic acid-methyl acrylate copolymer, a styrene-maleic anhydride copolymer, and the like, or a copolymer of the single copolymer and another monomer which can be copolymerized with the single copolymer; resin prepared in such a manner that a partial or perfect saponification material of polyvinyl acetate is partially acetalized by aldehyde such as acetaldehyde, benzaldehyde, hydroxybenzaldehyde, carboxybenzaldehyde, or the like; polyhydroxystyrene; and the like. Further, there are organic solvent soluble resins such as those having a cellulose alkyl ether group such as cellulose methyl ether, cellulose ethyl ether, and the like.

Moreover, the coating composition can be prepared by dissolving or dispersing one kind or more of the foregoing resin into a solvent comprising a single solvent or a mixture of two or more of, e.g., water; alcohol such as methanol, ethanol, or the like; ethylene glycol monomethyl ether; ethylene glycol monomethyl ether acetate; dimethylformamide; diethylformamide; dichloroethane; methyl ethyl ketone; cyclohexanone; toluene; or the like or into a solvent prepared by combining two or more of the foregoing solvents with each other.

As for the body to be coated, there may be mentioned, for example, a sheet or plate-like body. Examples of the material of the body to be coated include paper laminated with a plastic material such as polyethylene, polypropylene, polystyrene, or the like which is fused by heat; a metal plate comprised of aluminum, various aluminum alloys, zinc, iron, copper, or the like; a plastic film such as cellulose diacetate, cellulose butyrate, cellulose acetate butyrate, cellulose propionate, cellulose triacetate, cellulose nitrite, polyethylene terephthalate, polypropylene, polycarbonate, polyvinyl acetal, or the like; paper or a plastic film covered with metal as described above by lamination or evaporation, and the like.

As for the photosensitive compositions which may be used according to the present invention, compositions composed of diazo resin, o-quinonediazide compound, or the like are included.

The typical diazo resin is a condensation product of p-diazodiphenylamine and paraformaldehyde. The particularly preferable diazo compound is salt of condensation product of p-diazophenylamine and formaldehyde or acetaldehyde, which includes, for example, salt of phenol, fluorocapric acid or sulfonic acid such as triisopropylnaphthalenesulfonic acid, 4,4-biphenyldisulfonic acid, 5-nitroortho-toluenesulfonic acid, 5-sulfosalicylic acid, 2,5-dimethylbenzenesulfonic acid, 2-nitrobenzenesulfonic acid, 3-chlorobenzenesulfonic acid, 3-bromobenzenesulfonic acid, 2-chloro-5-nitrobenzenesulfonic acid, 2-fluorocaprylicnaphthalenesulfonic acid, 1-naphthol-5-sulfonic acid, 2-methoxy-4-hydroxy-5-benzolbenzenesulfonic acid, paratoluenesulfonic acid, or the like. The particularly preferable diazo compound is a compound having two or more diazo groups in one molecule thereof. As the other preferable diazo resin, a condensation product of 2,5-dimethoxy-4-p-tolylmercaptonbenzenediazonium and formaldehyde, and a concendation product of 2,5-dimethoxy-4-morpholinobenzenediazonium and formaldehyde or acetaldehyde are included, each of condensation products including the salt mentioned above.

The diazo resin disclosed in the British Patent No. 1,312,925 is also preferable.

The diazo resin can be individually used as a photosensitive material for forming the resist, but, preferably, the diazo resin is used with the binder.

Additionally, additives such as the phosphoric acid, the dye, the pigment, which are disclosed in the U.S. Pat. No. 3,236,646 can be added into the composite composed of the diazo resin.

The particularly preferable o-quinonediazide compound is o-naphthoquinonediazide compound, which is disclosed, for example, in the U.S. Pat. Nos. 2,766,118, 2,767,092, 2,772,972, 2,859,112, 2,907,665, 3,046,110, 3,046,111, 3,046,115, 3,046,118, 3,046,119, 3,046,120, 3,046,121, 3,046,122, 3,046,123, 3,061,430, 3,102,809, 3,106,465, 3,635,709, 3,647,443, and so on. The disclosed compound can be suitably and preferably used according to the present invention. Particularly, o-naphthoquinonediazidesulfonic acid ester or o-naphthoquinonediazidecarboxylic acid ester, which are of the aromatic hydroxy compound, and o-naphthoquinonediazidesulfonic acide amide or o-naphthoquinonediazidecarboxylicamide, which are of the aromatic amino compound, are preferred. More particuarly, the compound formed by the esterification of o-naphtholquinonediazidesulfonic acid with a condensation product of pyrogallol and acetone as disclosed in the U.S. Pat. No. 3,635,709, the compound formed by the estification of o-naphthoquinonediazidesulfonic acid or o-naphthoquinonediazidecarboxylic acid with polyester having hydroxy group as its end group as disclosed in the U.S. Pat. No. 4,028,111, or the compound formed by the estification of o-naphthoquinonediazidesulfonicacid or acid or o-naphthoquinonediazidecarboxylic acid with homopolymer of p-hydroxystyrene or copolymer of p-hydroxystyrene and monomer which can attain copolymerization therewith.

The o-quinonediazide compound noted above can be individually used, but, preferably, the o-quinonediazide compound is used while being mixed with the alkali soluble resin. As the preferable alkali suluble resin, the novolak type penol resin is included, and, more particularly, phenolformaldehyde resin, o-cresolformaldehyde resin, m-cresolformaldehyde resin, or the like is included. Further, as disclosed in the U.S. Pat. No. 4,123,279, it is preferable that the phenol resin noted above is used together with the compound of formaldehyde and phenol or cresol substituted by the alkyl group in which the number of carbon is from three to eight, such as t-butylphenolformaldehyde resin. The alkali soluble resin is contained in the photosensitive and resist formable composite at 50 to 80 weight or, more preferably, at 60 to 80 weight %, if the entire weight of the photosensitive and resist formable composite is set as a reference.

The pigment, the dye, the plasticizer, or the like can be included in the photosensitive composite composed of the o-quinonediazide compound as necessary.

In addition, the composite composed of the photosensitive azide compound, the composite composed of macromolecular compound having $$a \quad -CH{=}CH-\overset{\overset{\displaystyle O}{\|}}{C}-$$

group at its main chain or side chain of the polymer, and the photopolymerization composite composed of the addition polymerizable unsaturated compound can be used according to the present invention.

In order to further clarify the operation and effects of the present invention, examples will be described hereunder.

EXAMPLE 1

In the apparatus of FIG. 2 (*b*), a coating composition having the composition and physical property shown in Table 1 was applied from the first and second supply openings (4*b* and 4*c*) onto an aluminum film which was running at a speed of 60 m/min and having a width of 1000 mm and a thickness of 0.1 mm. In this case, the opening 4*a* and the drying zone 8 are not used. The quantity of application of the coating composition from each of the supply openings was 12 cc/m$^2$. The solvent of lower layer coating composition was evaporated at 50° C. for a very short time of about 5 sec in drying zone 9. Then, the thus obtained coating film which was still wet was further coated by supply opening 4*c*, and dried at 100° C. for 20 sec in drying zone 10 to thereby form a dried film. As a result, a film was produced in a short time and having coated thereon multilayers having good separation between the layers and having an exterior which was very smooth.

TABLE 1

| | |
|---|---|
| Composition of upper layer coating composition: | |
| cresol resin | 7 weight portion (including chlorine) |
| cellosolve acetate | 40 weight portion |
| methyl ethyl ketone | 8 weight portion |
| fluorine-group surface active agent | 0.02 weight portion |
| Composition of lower layer coating composition: | |
| phenol resin | 8 weight portion |
| cellosolve acetate | 40 weight portion |
| methyl ethyl ketone | 8 weight portion |

COMPARATIVE EXAMPLE 1

The same body as in Example 1 was coated with the composition of Table 1 by using an extrusion coater 18 in the apparatus of FIG. 2(*d*), and then dried at 100° C. for 30 sec. Mottles already appeared on the film surface immediately after the coating, and after drying, the film surface was further disturbed.

Figure 6:
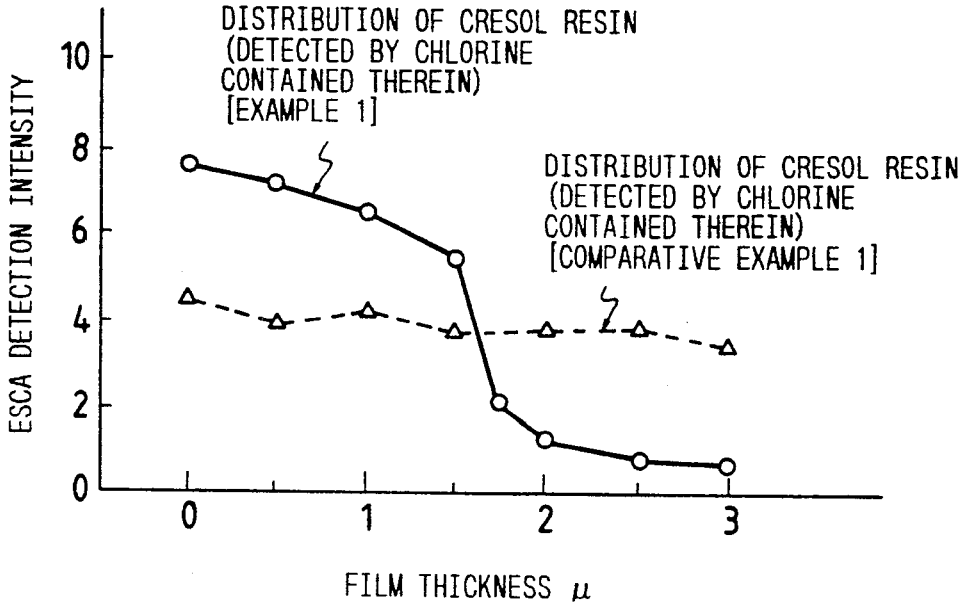
FIG. 6 is a view showing data of the example.

The amount of chlorine in the cresol resin of the upper layer of each of the foregoing coating films was analyzed by using an electron spectroscopy for chemical analysis (ESCA) while polishing the film. FIG. 6 is a graph in which the data derived from Example 1 and Comparative Example 1 was plotted. In FIG. 6, solid and a dotted lines represent measurement results of samples obtained from Example 1 and Comparative Example 1, respectively.

As can be seen from FIG. 6, in Comparative Example 1, diffusion/mixing was caused in the various layers of the coating composition in the time between coating and drying, and significant interlayer mixing occurred. In Example 1, on the contrary, it is found that only a little mixing was caused so that the layers were separated from each other. This directly resulted from the process by which the layers of Example 1 were coated.

EXAMPLE 2

An aluminum plate having a thickness of 0.24 mm was immersed in a 7% sodium tertiary phosphate aqueous solution (liquid temperature: 60° C.) for 3 minutes so as to be degreased, and then washed with water. The thus treated aluminum plate was rubbed with a nylon brush for the purpose of graining while making water having pumice suspended therein flow on the surface of the washed aluminum plate. Next, the aluminum plate was washed with water again, and immersed into a 5% aqueous solution of sodium silicate ($SiO_2/Na_2O=3.1$–$3.3$ (mole ratio)) (liquid temperature: 70° C.) for 30–60 seconds. Then, the aluminum plate was sufficiently washed with water, and dried.

The thus treated aluminum plate was coated, by roller coating, with the following coating Composition A to provide a coated amount of 0.3 g/m$^2$, and slightly dried so that only the film surface was dried. Next, the aluminum plate was coated with the following coating Composition B (the same as that of Composition A except for the dye) by the method according to the present invention as shown in diagram (a) of FIG. 2 in the case the supplying opening 4*a* and the following drying zone 9 are not used, but the opening 4*b* and the drying zone 10 are used, and obtain a dried film having a coated weight of Compositions A and B of 1.8 g/m$^2$. The thus obtained film was designated Example 1. In order to make a comparison, a coating Composition C only was applied by roll coating, and dried to prepare Example 2, the coating Composition C being prepared so that the dried film thereof contained an equal amount of dye and other solid components to those in Example 1.

In this comparison, extrusion multi layer coater is not used because good sample cannot be made for printing as estimated by ex. 1.

COMPOSITION A 2-hydroxy ethyl methacrylate copolymer (1) . . . 0.87 g (described in Example 1 in the specification of U.S. Pat. No. 4,123,276)
2-methoxy-4-hydroxy-5-benzyl benzene sulfonate of condensation product of P-diazo diphenylamine and paraformaldehyde . . . 0.1 g
methanol . . . 6 g
2-methoxy ethanol . . . 6 g

COMPOSITION B 2-hydroxy ethyl methacrylate copolymer (1) 0.87 g (described in Example 1 in the specification of U.S. Pat. No. 4,123,276)
2-methoxy-4-hydroxy-5-benzyl benzene sulfonate of condensation product of P-diazo diphenylamine and paraformaldehyde . . . 0.1 g
oil blue #603 (blue dye produced by Orient Chemical Industry Co., Ltd.) . . . 0.036 g
methanol . . . 6 g
2-methoxy ethanol . . . 6 g

COMPOSITION C 2-hydroxy ethyl methacrylate copolymer (1) 0.87 g (described in Example 1 in the specification of U.S. Pat. No. 4,123,276)
2-methoxy-4-hydroxy-5-benzyl benzene sulfonate of condensation product of P-diazo diphenylamine and paraformaldehyde . . . 0.1 g
oil blue #603 (blue dye produced by Orient Chemical Industry Co., Ltd.) . . . 0.0299 g
methanol . . . 6 g
2-methoxy ethanol . . . 6 g Each of the Examples was left for 5 days under the condition of 40° C. and 80% RH, and after exposure, subjected to plating treatment in the same manner as in the case of Example 1 described in the specification of the U.S. Pat. No. 4,123,276. When printing was performed by using the thus obtained planographic printing plates 1 and 2, no stain or smearing was found on the printed matter printed using the printing plate of Example 1, while scumming was found on the printed matter printed using the printing plate of Example 2. Hardly any other differences in printing performance such as print durability or the like were recognized between the printing plates of Examples 1 and 2.

By the process for producing photosensitive printing plate precursors according to the present invention, it has been made possible to produce a high-quality photosensitive printing plates with no interlayer mixing. Further, since multilayer coating can be successively continuously performed, the equipment can be made more compact and inexpensive, and since productivity can be improved, it has been made possible to realize reduction of the cost of production.

What is claimed is:

1. A process for forming a multilayer coating film comprising the steps of:

(a) atomizing a first coating composition in an atomizing room;
(b) forced draft conveying the atomized first coating composition from said atomizing room through an elongate transport passage to a supply nozzle such that large diameter particles of the first coating composition impact against and adhere to wall surfaces of the passage;
(c) establishing a high voltage electrical potential across an outlet of the nozzle to electrostatically charge the atomized first coating composition exiting the nozzle;
(d) impacting the electrostatically charged atomized first coating composition against a surface of a moving web such that the coating composition adheres to the web and forms a first coating film layer thereon;
(e) partially drying the first coating film layer so that a viscosity of the first coating film layer is 100 cp or more;
(f) repeating steps (a) through (d) for a second coating composition to form a second coating film layer on an upper surface of said first coating film layer; and
(g) running said first and second coating film layers, formed on said moving web, through a final drying zone to fully dry said multilayer coating film.

2. A process for forming a multilayer coating film, as recited in claim 1, wherein said first and second coating film layers are force draft conveyed through separate, consecutive transport passages.

3. A process for forming a multilayer coating film, as recited in claim 2, wherein said moving web passes through a partial drying zone, between said separate, consecutive transport passages, for partially drying said first layer.

4. A process for forming a multilayer coating film, as recited in claim 1, wherein said web carried a sheet-like body to be coated and wherein said multilayer coating film is formed on an upper surface of said sheet-like body carried by said web.

5. A process for forming a multilayer coating film, as recited in claim 1, wherein the mean diameter of the atomized coating composition particles is less than or equal to about 50 μm.

6. A process for forming a multilayer coating film, as recited in claim 1, wherein the viscosity of the atomized coating composition ranges from between about 5 cP and about 100 cP.

7. A process for forming a multilayer coating film, as recited in claim 4, wherein said process is used to produce a photosensitive printing plate precursor comprising a plurality of layers of a photosensitive coating component formed on said sheet-like body.

8. A process for forming a multilayer elating film comprising the steps of:

(a) atomizing a first coating composition in an atomizing room;
(b) forced draft conveying the atomized first coating composition from said atomizing room through an elongate transport passage to a supply nozzle such that large diameter particles of the first coating composition impact against and adhere to wall surfaces of the passage;
(c) establishing a high voltage electrical potential across an outlet of the nozzle to electrostatically charge the atomized first coating composition existing the nozzle;

(d) impacting the electrostatically charged atomized first coating composition against a surface of a moving web such that the coating composition adheres to the web and forms a first coating film layer thereon;

(e) partially drying the first coating film layer so that a viscosity of the first coating film layer is 100 cp or more;

(f) repeating steps (a) and (e) for a second coating composition to form a second coating film layer on an upper surface of said first coating film layer;

(g) repeating steps (a) through (d) for a third coating composition to form a third coating film layer on an upper surface of said second coating film layer; and (h) running said first, second and third coating film layers, formed on said moving web, through a final drying zone to fully dry said multilayer coating film.

9. A process for forming a multilayer coating film, as recited in claim 8, wherein at least one coating film layer is a charge generating layer comprising a charge generating agent and at least one coating film layer is a charge transporting layer comprising a charge transporting agent.

* * * * *